US010157579B2

(12) United States Patent
Han et al.

(10) Patent No.: US 10,157,579 B2
(45) Date of Patent: Dec. 18, 2018

(54) ORGANIC LIGHT EMITTING DISPLAY DEVICE

(71) Applicant: LG DISPLAY CO., LTD., Seoul (KR)

(72) Inventors: Sung Man Han, Paju-si (KR); Jong Sik Shim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/850,646

(22) Filed: Sep. 10, 2015

(65) Prior Publication Data

US 2016/0098961 A1 Apr. 7, 2016

(30) Foreign Application Priority Data

Oct. 1, 2014 (KR) ..... 10-2014-0132661

(51) Int. Cl.

| | |
|---|---|
| ***G09G 3/30*** | (2006.01) |
| ***G09G 3/32*** | (2016.01) |
| ***G09G 3/3291*** | (2016.01) |
| ***G09G 3/3225*** | (2016.01) |

(52) U.S. Cl.

CPC ..... *G09G 3/3291* (2013.01); *G09G 3/3225* (2013.01); *G09G 2300/0814* (2013.01); *G09G 2300/0842* (2013.01); *G09G 2310/0262* (2013.01); *G09G 2310/0272* (2013.01); *G09G 2310/08* (2013.01); *G09G 2320/029* (2013.01); *G09G 2320/0233* (2013.01); *G09G 2320/043* (2013.01); *G09G 2320/045* (2013.01)

(58) Field of Classification Search

CPC .. G09G 5/00; G09G 5/10; G09G 3/30; G09G 3/32; G09G 3/3258; G09G 3/3233; G09G 3/3291; H01L 27/3262; G06F 3/038; H05B 37/02

See application file for complete search history.

(56) References Cited

U.S. PATENT DOCUMENTS

2011/0025671 A1* 2/2011 Lee ..... G09G 3/003 345/211
2011/0298836 A1* 12/2011 Komiya ..... G09G 3/3233 345/690
2012/0075361 A1* 3/2012 Kishi ..... G09G 3/3225 345/690
2013/0050292 A1* 2/2013 Mizukoshi ..... G09G 3/3291 345/690
2013/0083001 A1 4/2013 Jeong (Continued)

FOREIGN PATENT DOCUMENTS

KR 10-2013-0036661 A 4/2013
KR 10-2014-0091095 A 7/2014

*Primary Examiner* — Chanh Nguyen
*Assistant Examiner* — Nguyen H Truong
(74) *Attorney, Agent, or Firm* — Birch, Stewart, Kolasch & Birch, LLP

(57) ABSTRACT

A display device is discussed, which includes: a light emitting diode to emit light; and a pixel circuit connected to the light emitting diode, the pixel circuit including; a data line; a driving power line; a sense signal line; a gate line; and a switch connected with the data line by a first terminal, a digital-to-analog converter by a second terminal, and an analog-to-digital converter by a third terminal, wherein the switch connects the data line to the digital-to-analog converter or the analog-to-digital converter on a basis of a switch control signal.

14 Claims, 5 Drawing Sheets

(56) References Cited

U.S. PATENT DOCUMENTS

| | | | | |
|---|---|---|---|---|
| 2013/0147694 | A1* | 6/2013 | Kim | G09G 3/32 345/82 |
| 2014/0176409 | A1 | 6/2014 | Kim et al. | |
| 2015/0053953 | A1* | 2/2015 | Ebisuno | G09G 3/3233 257/40 |
| 2015/0213757 | A1* | 7/2015 | Takahama | G09G 3/3291 345/691 |

* cited by examiner

ORGANIC LIGHT EMITTING DISPLAY DEVICE

CROSS REFERENCE TO RELATED APPLICATIONS

This application claims the priority benefit of the Korean Patent Application No. 10-2014-0132661 filed on Oct. 1, 2014, which is hereby incorporated by reference as if fully set forth herein.

BACKGROUND OF THE INVENTION

Field of the Disclosure

Embodiments of the present invention relate to an organic light emitting display device which facilitates to improve picture quality by improving an aperture ratio of a pixel, and to reduce a manufacturing cost by decreasing the number of channels in a data driver.

Discussion of the Related Art

With the advancement of an information-oriented society, various requirements for the display field to visually express an electrical information signal are increasing rapidly, and thus, research is being conducted on various flat display devices that are thin, light, and have low power consumption.

For example, the flat display devices may be liquid crystal display (LCD) devices, plasma display panel (PDP) devices, field emission display (FED) devices, organic light emitting display (OLED) devices, etc. Among these flat display devices, the organic light emitting display (OLED) device has been attracted as a next-generation flat panel display owing to advantages of rapid response speed and low power consumption. In addition, the organic light emitting display device can self emit light.

FIG. 1 illustrates a pixel circuit and an organic light emitting diode provided in a pixel of an organic light emitting display device according to a related art. FIG. 1 illustrates an equivalent circuit of one pixel among a plurality of pixels provided in a display panel.

Referring to FIG. 1, the organic light emitting diode (OLED) provided in each pixel of the organic light emitting display device is electrically connected between a cathode power source (EVSS) and a source terminal of a driving thin film transistor (driving TFT, DT), whereby the organic light emitting diode emits light by a data current (I_oled) supplied from the driving TFT (DT). The organic light emitting diode (OLED) emits light by controlling a level of the data current (I_oled) flowing from a first driving power (EVDD) terminal to the organic light emitting diode (OLED) through the driving TFT (DT), to thereby display a predetermined image.

Due to non-uniformity in a manufacturing process of a thin film transistor (TFT), the properties of threshold voltage (Vth) and mobility of the driving TFT (DT) and first and second switching TFTs (ST1, ST2) included in the pixel circuit may be differently shown by each pixel. Thus, even though a data voltage (Vdata) is identically applied to the driving TFT (DT) for each pixel, a deviation of current flowing in the organic light emitting diode (OLED) occurs so that it is difficult to realize uniformity in picture quality.

Also, the driving TFT may have a problem relating to a deterioration of the properties of a threshold voltage and a mobility with the lapse of driving time. This deterioration becomes more serious with a lapse of driving time. Thus, even though the data voltage (Vdata) is applied identically, the current flowing in the organic light emitting diode (OLED) is gradually reduced so that a luminance becomes low.

In order to overcome these problems, there has been developed a method for sensing the properties of threshold voltage and mobility in the driving TFT (DT) of each pixel, and compensating for the change of properties in the driving TFT (DT) by an external compensation method.

A sense signal line (SL) is formed in the same direction as that of a gate line (GL), and a second switching TFT (ST2) is formed and switched by a sense signal (sense) applied to the sense signal line (SL). As a pre-charging voltage is supplied to a pixel to be sensed, and the second switching TFT (ST2) is selectively switched, the data current (I_oled) supplied to the organic light emitting diode (OLED) is supplied to an analog-to-digital converter (ADC) of a drive IC via a reference power line (RL).

After sensing the threshold voltage and mobility of the driving TFT (DT), the data current is converted into compensation data corresponding to the change of threshold voltage and mobility of the driving TFT of the pixel (P) through the use of the analog-to-digital converter (ADC) based on the sensing result value.

In the organic light emitting display device according to the related art, the reference power line (RL) is formed to sense the change of properties in the driving TFT (DT) of each pixel, whereby an aperture ratio of the pixel is lowered.

As a reference voltage (Vref) is supplied to the reference power line (RL), the number of channels in a data driver (D-IC) is increased so that a manufacturing cost of the data driver (D-IC) is increased, thereby increasing a manufacturing cost of the organic light emitting display device.

FIG. 2 is a waveform diagram of the sense signal in the organic light emitting display device according to the related art.

Referring to FIG. 2, a real-time sensing process is carried out by supplying the sense signal to each sense signal line or several sense signal lines by each line unit or each group unit.

In order to reduce the sensing time, when the sense signal is supplied to the sense signal line, the consecutive two sense signals are overlapped by ½ time. That is, the (N−1)th sense signal and the N-th sense signal are overlapped by ½ time, and the N-th sense signal and the (N+1)th sense signal are overlapped by ½ time, to thereby sense the properties (threshold voltage and mobility) of the driving TFT (DT) for the entire pixels.

For the overlap driving of the sense signal, when a short occurs between the reference voltage (Vref) and low-potential driving voltage (EVSS) in the N-th line, the reference voltage (Vref) is lowered to the low-potential driving voltage (EVSS) (Vref→EVSS), and Vgs voltage of the (N−1)th line becomes high, whereby a luminance of each organic light emitting diode (OLED) in the pixels formed in the (N−1)th line becomes high. Accordingly, a luminance deviation occurs between the pixels of the prior sense signal line and the pixels of the next sense signal line with respect to the corresponding sense signal line, thereby causing deterioration of picture quality, for example, spots on a screen.

SUMMARY OF THE INVENTION

Accordingly, embodiments of the present invention are directed to an organic light emitting display device that substantially obviates one or more problems due to limitations and disadvantages of the related art.

An aspect of embodiments of the present invention is directed to providing an organic light emitting display device which facilitates to improve an aperture ratio of a pixel.

Another aspect of embodiments of the present invention is directed to providing an organic light emitting display device which facilitates to decrease the number of channels in a data driver by removing a reference power line, and further to decrease a manufacturing cost of the organic light emitting display device.

Another aspect of embodiments of the present invention is directed to providing a display device including: a light emitting diode to emit light; and a pixel electrode connected to the light emitting diode, the pixel electrode including a data line; a driving power line; a sense signal line; a gate line; and a switch connected with the data line by a first terminal, a digital-to-analog converter by a second terminal, and an analog-to-digital converter by a third terminal, wherein the switch connects the data line to the digital-to-analog converter or the analog-to-digital converter on a basis of a switch control signal.

Another aspect of embodiments of the present invention is directed to providing a method of operation of a display device including a pixel circuit and a light emitting diode, and including: in a display mode of the pixel circuit: switching a switch to connect a data line to a digital-to-analog converter based on a switch control signal so that a data voltage is supplied from the digital-to-analog converter to the data line; supplying a scan signal to a first switching TFT to turn on the first switching TFT, supplying a second driving power from a second driving power terminal to a first node connected with a gate electrode of a driving TFT so that a driving current for light emission of a light emitting diode is supplied to an anode electrode of the light emitting diode; and supplying the scan signal to a second switching TFT to supply the data voltage of negative polarity supplied to the data line to a third node to which the light emitting diode and a drain electrode of the driving TFT are connected, and in a sensing mode of the pixel circuit: turning on the first switching TFT and supplying the second driving power from the second driving power terminal to the first node connected with the gate electrode of the driving TFT so that a difference voltage between a first driving power and a gate-source voltage is formed in the third node connected with the light emitting diode and the drain electrode of the driving TFT; and supplying the sense signal to the second switching TFT, whereby a sensing voltage of the driving TFT in the form of a voltage formed in the third node to which the light emitting diode and the drain electrode of the driving TFT are connected is supplied to the data line.

Additional advantages and features of the embodiments of the invention will be set forth in part in the description which follows and in part will become apparent to those having ordinary skill in the art upon examination of the following or may be learned from practice of embodiments of the invention. The objectives and other advantages of the embodiments of the invention may be realized and attained by the structure particularly pointed out in the written description and claims hereof as well as the appended drawings.

It is to be understood that both the foregoing general description and the following detailed description of the embodiments of the present invention are by example and explanatory and are intended to provide further explanation of the embodiments of the present invention as claimed.

BRIEF DESCRIPTION OF THE DRAWINGS

The accompanying drawings, which are included to provide a further understanding of embodiments of the present invention and are incorporated in and constitute a part of this application, illustrate embodiment(s) of the present invention and together with the description serve to explain the principle of embodiments of the present invention. In the drawings.

DETAILED DESCRIPTION OF THE EMBODIMENTS

Figure 1:
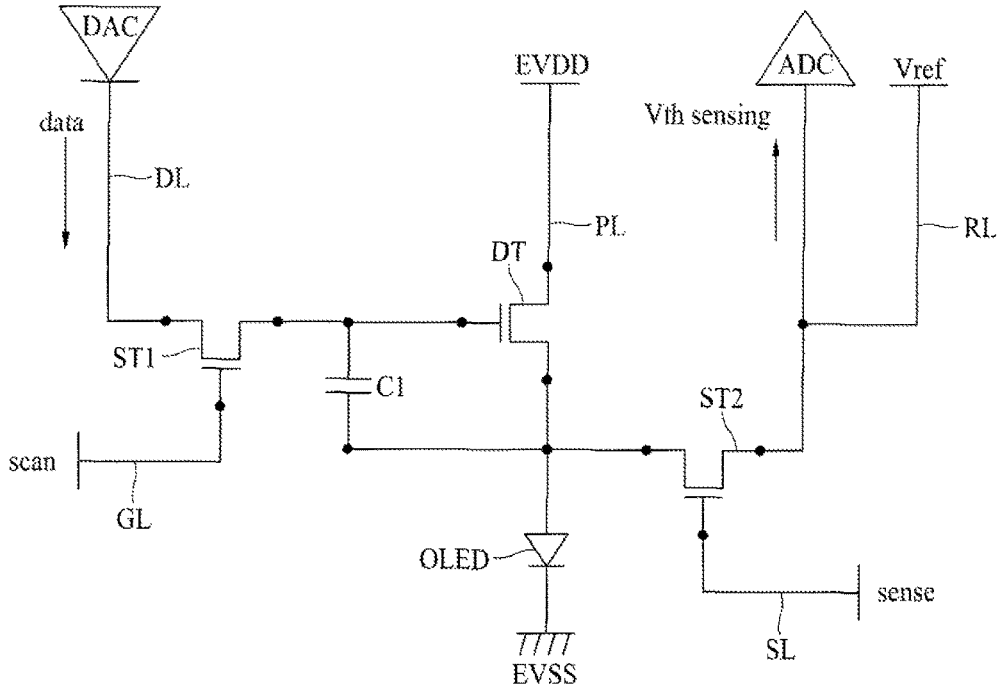
FIG. 1 (RELATED ART)
FIG. 1 illustrates a pixel circuit and an organic light emitting diode provided in a pixel of an organic light emitting display device according to the related art.
Figure 2:
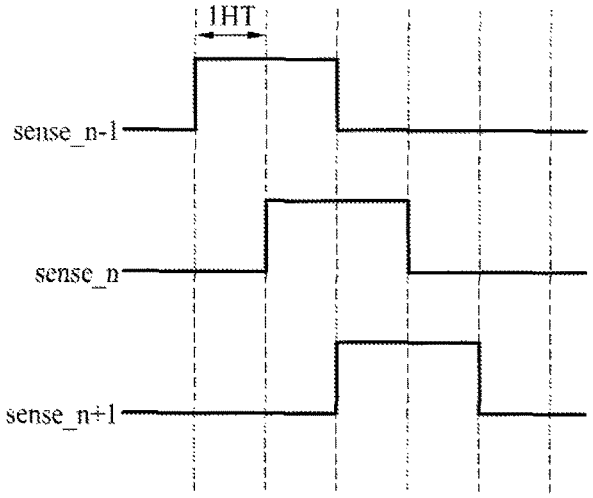
FIG. 2 (RELATED ART)
FIG. 2 is a waveform diagram of a sense signal in the organic light emitting display device according to the related art.

Reference will now be made in detail to the example embodiments of the present invention, examples of which are illustrated in the accompanying drawings. Wherever possible, the same reference numbers will be used throughout the drawings to refer to the same or like parts.

Advantages and features of the present invention, and implementation methods thereof will be clarified through the following embodiments described with reference to the accompanying drawings. The present invention may, however, be embodied in different forms and should not be construed as limited to the embodiments set forth herein. Rather, these embodiments of the present invention are provided so that this disclosure will be thorough and complete, and will fully convey the scope of the present invention to those skilled in the art. Further, the embodiments of the present invention are only defined by scopes of claims.

A shape, a size, a ratio, an angle, and a number disclosed in the drawings for describing embodiments of the present invention are merely an example, and thus, the present invention is not limited to the illustrated details. Like reference numerals refer to like elements throughout. In the following description, when the detailed description of the relevant known function or configuration is determined to unnecessarily obscure the important point of the present invention, the detailed description will be omitted. In a case where 'comprise', 'have', and 'include' described in the present specification are used, another part may be added unless 'only~' is used. The terms of a singular form may include plural forms unless referred to the contrary. In construing an element, the element is construed as including an error region although there is no explicit description.

In description of embodiments of the present invention, when a structure (for example, an electrode, a line, a wiring, a layer, or a contact) is described as being formed at an upper portion/lower portion of another structure or on/under the other structure, this description should be construed as including a case where the structures contact each other and moreover, a case where a third structure is disposed therebetween.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present invention.

Features of various embodiments of the present invention may be partially or overall coupled to or combined with each other, and may be variously inter-operated with each other and driven technically as those skilled in the art can sufficiently understand. The embodiments of the present invention may be carried out independently from each other, or may be carried out together in co-dependent relationship.

Hereinafter, an organic light emitting display device according to the embodiment of the present invention and a method for driving thereof will be described with reference to the accompanying drawings.

Figure 3:
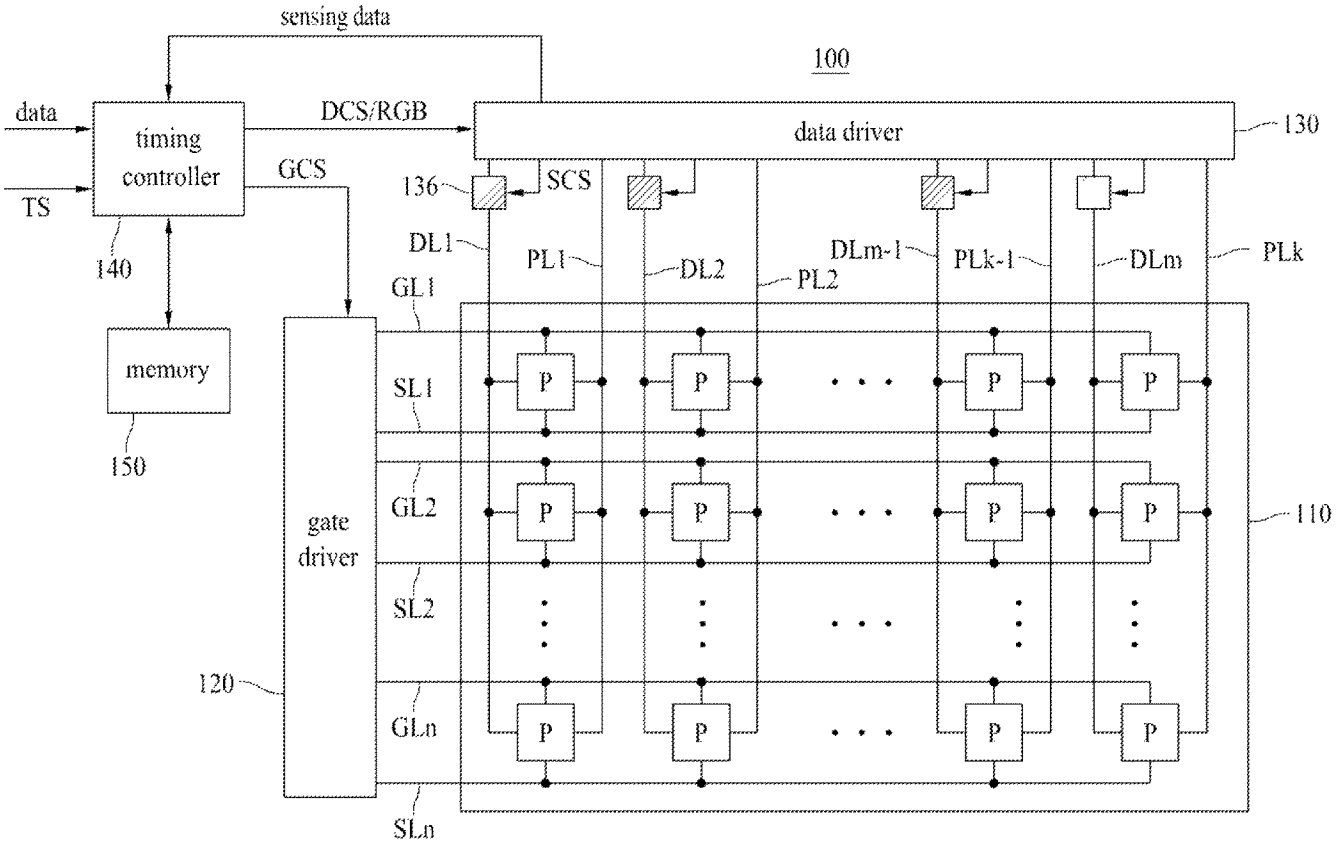
FIG. 3 illustrates an organic light emitting display device according to an embodiment of the present invention.

FIG. 3 illustrates an organic light emitting display device according to the embodiment of the present invention.

Referring to FIG. 3, the organic light emitting display device 100 according to the embodiment of the present invention may include an OLED panel 110 and a driving circuit. The driving circuit may include a gate driver 120, a data driver 130, a timing controller 140, and a memory 150 with compensation data stored therein.

On the OLED panel 110, there are a plurality of gate lines (GL), a plurality of sense signal lines (SL), a plurality of data lines (DL), and a plurality of driving power lines (PL). Also, a plurality of pixels (P) are defined on the OLED panel 110 by the plurality of lines (GL, SL, DL, PL).

Each of the pixels (P) may be any one among red, green, and blue pixels. A unit pixel for displaying an image may comprise red, green and blue pixels. Also, a unit pixel for displaying an image may comprise red, green, blue and white pixels. The plurality of pixels (P) of the organic light emitting display device 100 according to the embodiment of the present invention emit light in a top emission method, to thereby display an image.

Based on a timing signal (TS), the timing controller 140 generates a gate control signal (GCS) and a data control signal (DCS) for driving the gate driver 120 and the data driver 130 in a display or sensing mode. The timing controller 140 respectively supplies the generated data control signal (DCS) and the generated gate control signal (GCS) to the gate driver 120 and the data driver 130.

The timing signal (TS) may be a vertically synchronized signal (Vsync), a horizontally synchronized signal (Hsync), a data enable (DE), a clock (DCLK), and etc. The gate control signal (GCS) may include a gate start signal, and a plurality of clock signals. The data control signal (DCS) may include a data start signal, a data shift signal, and a data output signal.

For the display mode, the timing controller 140 drives the gate driver 120 and the data driver 130 in the display mode. Under the control of the timing controller 140, a scan signal is generated in the gate driver 120. Also, the timing controller 140 converts analog image data into digital image data by a frame unit, and supplies the digital image data to the data driver 130. Also, the timing controller 140 converts the digital image data of the data driver 130 into an analog data voltage, and makes the data driver 130 supply the analog data voltage to each pixel.

For the sensing mode, the timing controller 140 drives the gate driver 120 and the data driver 130 in the sensing mode. Under the control of the timing controller 140, a sense signal is generated in the gate driver 120. Also, the timing controller 140 controls an analog-to-digital converter (ADC) of the data driver 130 so as to sense a change of threshold voltage and mobility in a driving TFT (DT) for each pixel.

The sensing mode is performed at an initial driving time point of the OLED panel 110, an end point after a long-time driving of the OLED panel 110, or during a period for displaying an image on the OLED panel 110.

In accordance with a mode control of the timing controller 140, the gate driver 120 may be driven in the display mode or sensing mode. The gate driver 120 may include a plurality of first channels, and a plurality of second channels. The plurality of first channels are connected with the plurality of gate lines (GL), and the plurality of second channels are connected with the plurality of sense signal lines (SL).

For the display mode, the gate driver 120 generates a scan signal (scan) of a gate-on voltage level every 1 horizontal period in accordance with the gate control signal (GCS) supplied from the timing controller 140, and sequentially supplies the generated scan signal (scan) to the plurality of gate lines (GL) and the plurality of sense signal lines (SL). The scan signal (scan) has the gate-on voltage level for a data-charging period of each pixel (P), and the scan signal (scan) has a gate-off voltage level for a light-emitting period of each pixel (P).

For the sensing mode, the gate driver 120 generates a sense signal (sense) of a gate-on voltage level, and sequentially supplies the sense signal (sense) to the plurality of sense signal lines (SL). Also, the gate driver 120 generates a scan signal (scan) of a gate-on voltage level. In this case, the gate driver 120 supplies the sense signal (sense) to the sense signal line (SL), and sequentially supplies the scan signal (scan) to the plurality of gate lines (GL).

The sense signal (sense) may be sequentially supplies to each sense signal line (SL.). According to another example, the sense signal (sense) may be supplied to each sensing block comprising the plurality of sense signal lines (SL). As the sense signal (sense) is supplied to the sense signal line (SL), it is possible to sense the threshold voltage and mobility of each driving TFT (DT) for the plurality of pixels connected with each sense signal line (SL).

As the sense signal (sense) is sequentially supplied to each sense signal line (SL), it is possible to sense the threshold voltage and mobility of each driving TFT (DT) for the plurality of pixels by each 1 horizontal line. Meanwhile, if the sense signal (sense) is supplied to the plurality of sense signal lines (SL), it is possible to sense the threshold voltage and mobility of each driving TFT (DT) for the plurality of pixels arranged in the plurality of horizontal lines.

The gate driver 120 may be formed in an integrated circuit (IC) type, or may be provided in an array substrate of the OLED panel 110 by a GIP (gate in panel) method for a process of forming the thin film transistor for each pixel (P).

For the display mode, the data driver 130 generates a data voltage (Vdata) of a negative (−) polarity in accordance with the digital image data, and supplies the generated data voltage (Vdata) to the plurality of data lines (DL). The OLED formed in each pixel emits light with a luminance corresponding to the data voltage (Vdata).

For the sensing mode, the data driver 130 receives a sensing voltage for sensing the change of threshold voltage and mobility of each driving TFT (DT) for all the pixels or some pixels of the OLED panel 110, converts the sensing voltage to digital data, and transmits the digital data to the timing controller 140.

The plurality of gate lines (GL) and the plurality of sense signal lines (SL) may be provided in a first direction (for example, horizontal direction) of the OLED panel 110. In this case, the scan signal (scan) is applied to the gate line (GL) from the gate driver 120 of the driving circuit. Also, the sense signal (sense) is applied to the sense signal line (SL) from the gate driver 120 of the driving circuit.

The plurality of driving power lines (PL) intersect with the gate lines (GL) and the sense signal lines (SL), and the plurality of driving power lines (PL) are formed in parallel to the data lines (DL). That is, the plurality of driving power lines (PL) are formed in a second direction (for example, vertical direction) of the OLED panel 110. Through the plurality of driving power lines (PL), a first driving power (EVDD) is supplied to a drain electrode of the driving TFT (DT) for each pixel (P) from the data driver 130.

The plurality of data lines (DL) intersect with the plurality of gate lines (GL) and the plurality of sense signal lines (SL), and the plurality of data lines (DL) are formed in parallel to the driving power line (PL). That is, the plurality of data lines (DL) are formed in the second direction (for example, vertical direction) of the OLED panel 110. In this case, the data voltage (Vdata) of negative (−) polarity is supplied from the data driver 130 of the driving circuit to the data line (DL). The data voltage (Vdata) includes a compensation voltage corresponding to the change of threshold voltage and mobility of the driving TFT (DT) for the corresponding pixel (P).

In case of the organic light emitting display device according to the embodiment of the present invention, the data line (DL) is used to supply the data voltage (Vdata) to the driving TFT (DT), and also to sense the threshold voltage of the driving TFT (DT). In case of the related art, the reference power line (RL) is formed as shown in FIG. 1. However, the organic light emitting display device according to the embodiment of the present invention senses the threshold voltage of the driving TFT (DT) by the use of data line (DL) instead of the reference power line (RL).

To this end, a plurality of switches 136 are provided in a non-display area of the OLED panel 110. The plurality of switches 136 switch a path of the data line (DL) to the analog-to-digital converter (ADC) or digital-to-analog converter (DAC) of the data driver 130 in accordance with a switch control signal (SCS) input from the data driver 130. An operation of the plurality of switches 136 will be described with reference to FIG. 4.

Figure 4:
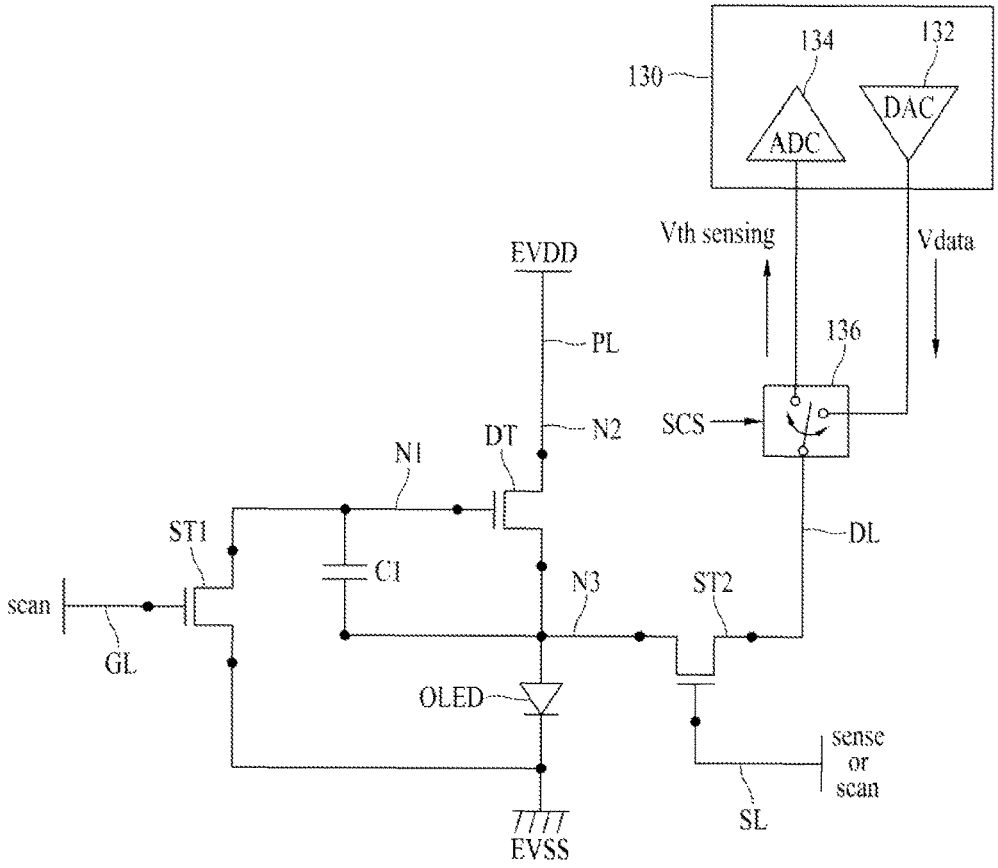
FIG. 4 illustrates a pixel circuit and an organic light emitting diode (OLED) provided in a pixel of the organic light emitting display device according to an embodiment of the present invention.

FIG. 4 illustrates a pixel circuit and an organic light emitting diode (OLED) provided in the pixel of the organic light emitting display device according to the embodiment of the present invention.

Referring to FIG. 4, each of the plurality of pixels may include the organic light emitting diode (OLED) and the pixel circuit. The pixel circuit for making the organic light emitting diode (OLED) emit light and sensing the threshold voltage may include three transistors and one capacitor (3 Tr 1 C). Also, there are one data line (DL), one driving power line (PL), one sense signal line (SL), and one gate line (GL).

The pixel circuit may include a first switching TFT (ST1), a second switching TFT (ST2), a driving TFT (DT), and a capacitor (C1). In this case, the first, second and driving TFTs (ST1, ST2, DT) may be N-type TFTs, and may be formed of a-Si TFT, poly-Si TFT, oxide TFT, organic TFT, and etc., but not limited to the above type and materials. For example, the first, second and driving TFTs (ST1, ST2, DT) may be P-type TFTs.

The first switching TFT (ST1) may include a gate electrode connected with the gate line (GL), a source electrode connected with a second driving power (EVSS) terminal, and a drain electrode connected with a first node (N1) connected with the gate electrode of the driving TFT (DT). As the first switching TFT (ST1) is turned-on by the scan signal of gate-on voltage level supplied to the gate line (GL), the first switching TFT (ST1) supplies a second driving power (EVSS) supplied from a second driving power (EVSS) terminal to the first node (N1) connected with the gate electrode of the driving TFT (DT).

The capacitor (C1) is connected between the gate and source electrodes of the driving TFT (DT). The capacitor (C1) is charged with a voltage of difference between the data voltage and a gate-drain voltage (Vgd) of the driving TFT (DT).

The second switching TFT (ST2) may include a gate electrode connected with the sense signal line (SL), a source electrode connected with the data line (DL), and a drain electrode connected with a third mode (N3) connected with the driving TFT (DT) and the organic light emitting diode (OLED).

For the display mode, the second switching TFT (ST2) is turned-on by the scan signal (scan) of gate-on voltage supplied to the sense signal line (SL), whereby the data voltage of negative (−) polarity supplied from the digital-to-analog converter (DAC) 132 of the data driver 130 is supplied to the third node (N3) to which the driving TFT (DT) and the organic light emitting diode (OLED) are connected.

For the sensing mode, the second switching TFT (ST2) is turned-on by the sense signal (sense) of gate-on voltage level supplied to the sense signal line (SL), whereby the gate-drain voltage (Vgd) of the driving TFT (DT) is supplied to the analog-to-digital converter (ADC) 134 of the data driver 130 through the data line (DL).

The driving TFT (DT) includes a gate electrode connected with the drain electrode of the first switching TFT (ST1) and a first electrode of the capacitor (C1) in common. Also, the driving TFT (DT) includes a source electrode connected with the driving power line (PL). The driving TFT (DT) includes a drain electrode connected with the drain electrode of the second switching TFT (ST2), a second electrode of the capacitor (C1), and an anode electrode of the organic light emitting diode (OLED).

The second driving power (EVSS) is supplied to the gate node (N1) of the driving TFT (DT), and the data voltage (Vdata) is supplied to a source node (N2) of the driving TFT (DT). The gate-drain voltage (Vdg) is charged in the capacitor (C1) connected between the gate and drain electrodes of the driving TFT (DT), and the data current (I_oled) flowing from the first driving power (EVDD) terminal to the second driving power (EVSS) terminal is controlled so that the organic light emitting diode (OLED) emits light.

The organic light emitting diode (OLED) emits the light by the data current (I_oled) supplied from the driving TFT (DT), to thereby emit the light with luminance corresponding to the data current (I_oled).

A first terminal of the plurality of switches 136 is connected with the data line (DL), a second terminal thereof is connected with the digital-to-analog converter (DAC) 132 of the data driver 130, and a third terminal thereof is connected with the analog-to-digital converter (ADC) 134 of the data driver 130. The plurality of switches 136 connect the data line (DL) to the digital-to-analog converter (DAC) 132 or the analog-to-digital converter (ADC) 134 on the basis of switch control signal (SCS) input from the data driver 130.

Through the use of switches 136, the data line (DL) may be connected with the digital-to-analog converter (DAC) 132 or analog-to-digital converter (ADC) 134 so as to supply the data voltage (Vdata) to the pixel, or may be used to supply the sensing voltage of the pixel to the analog-to-digital converter (ADC) 134. Thus, it is possible to remove the reference power line (RL) necessarily provided for the sensing function in the related art. As the reference power line (RL) is removed from the organic light emitting display device according to the embodiment of the present invention, it is possible to improve an aperture ratio of the pixel, and also to reduce the number of channels in the data driver, thereby reducing a manufacturing cost of the organic light emitting display device.

Figure 5:
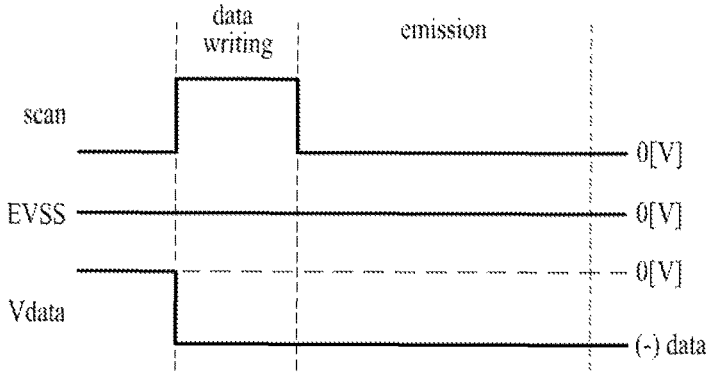
FIG. 5 is a waveform diagram of a display mode according to an embodiment of the present invention.
Figure 6:
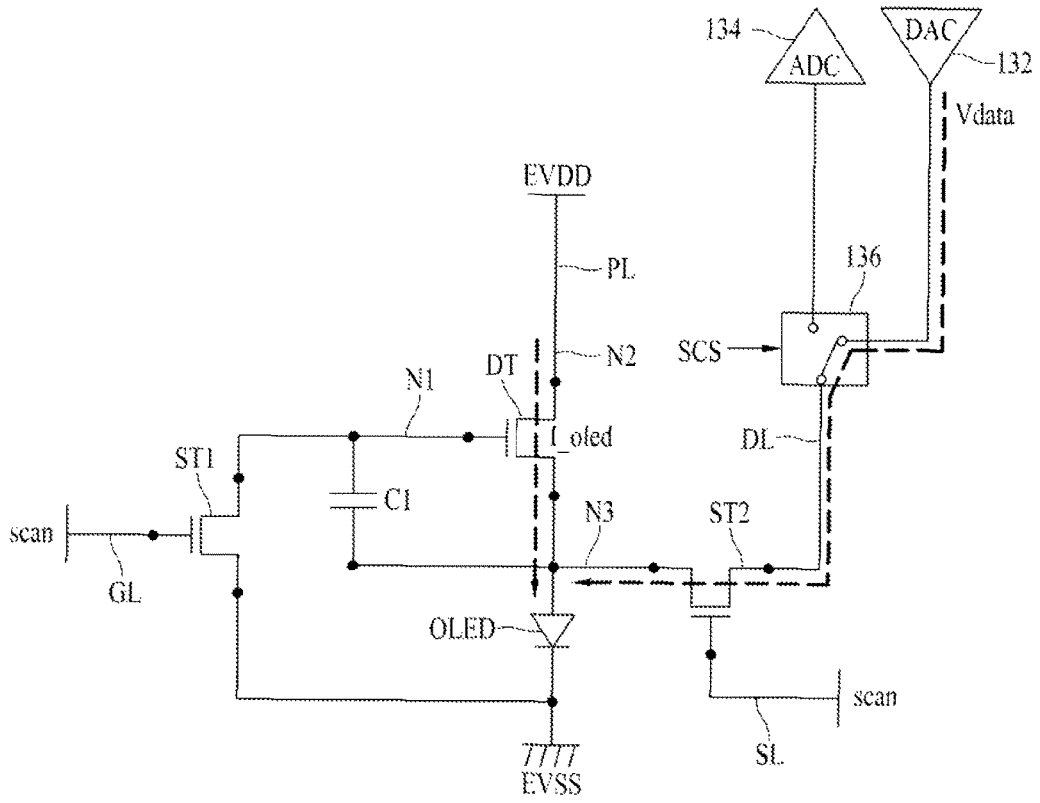
FIG. 6 illustrates a driving method of the pixel circuit for the display mode according to an embodiment of the present invention.

FIG. 5 is a waveform diagram of the display mode, and FIG. 6 illustrates a driving method of the pixel circuit for the display mode.

Referring to FIGS. 5 and 6, as the plurality of switches 136 are switched by the switch control signal (SCS) input from the data driver 130 in accordance with the display mode, the data line (DL) is connected with the digital-to-analog converter (DAC) 132. If the data line (DL) is connected with the digital-to-analog converter (DAC) 132, the data voltage (Vdata) is supplied from the digital-to-analog converter (DAC) 132 of the data driver 130 to the data line (DL).

In this case, as the scan signal (scan) is supplied to the first switching TFT (ST1), the first switching TFT (ST1) is turned-on, and the second driving power (EVSS) is supplied from the second driving power (EVSS) terminal to the first node (N1) connected with the gate electrode of the driving TFT (DT). Thus, the driving current (I_oled) for the light emission of the organic light emitting diode (OLED) is supplied to the anode electrode of the organic light emitting diode (OLED).

As the scan signal (scan) is supplied to the second switching TFT (ST2), the data voltage (Vdata) of negative (−) polarity supplied to the data line (DL) is supplied to the third node (N3) to which the organic light emitting diode (OLED) and the drain electrode of the driving TFT (DT) are connected.

Thus, the source node of the driving TFT (DT) is boosted to a driving point of the organic light emitting diode (OLED), and the gate node of the driving TFT (DT) is boosted, whereby the organic light emitting diode (OLED) emits the light by the driving current (I_oled) corresponding to a gate-source voltage (Vgs).

Figure 7:
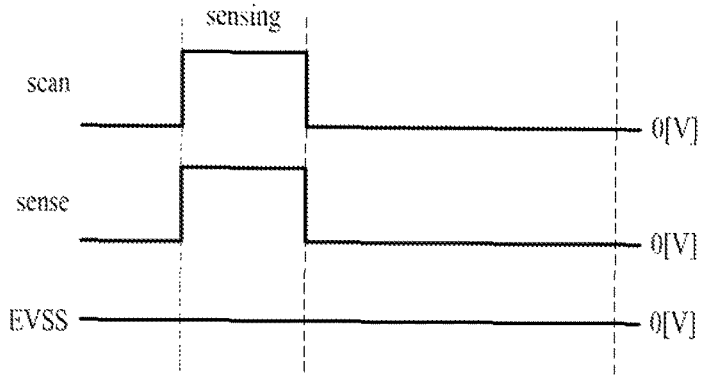
FIG. 7 is a waveform diagram of a sensing mode according to an embodiment of the present invention.
Figure 8:
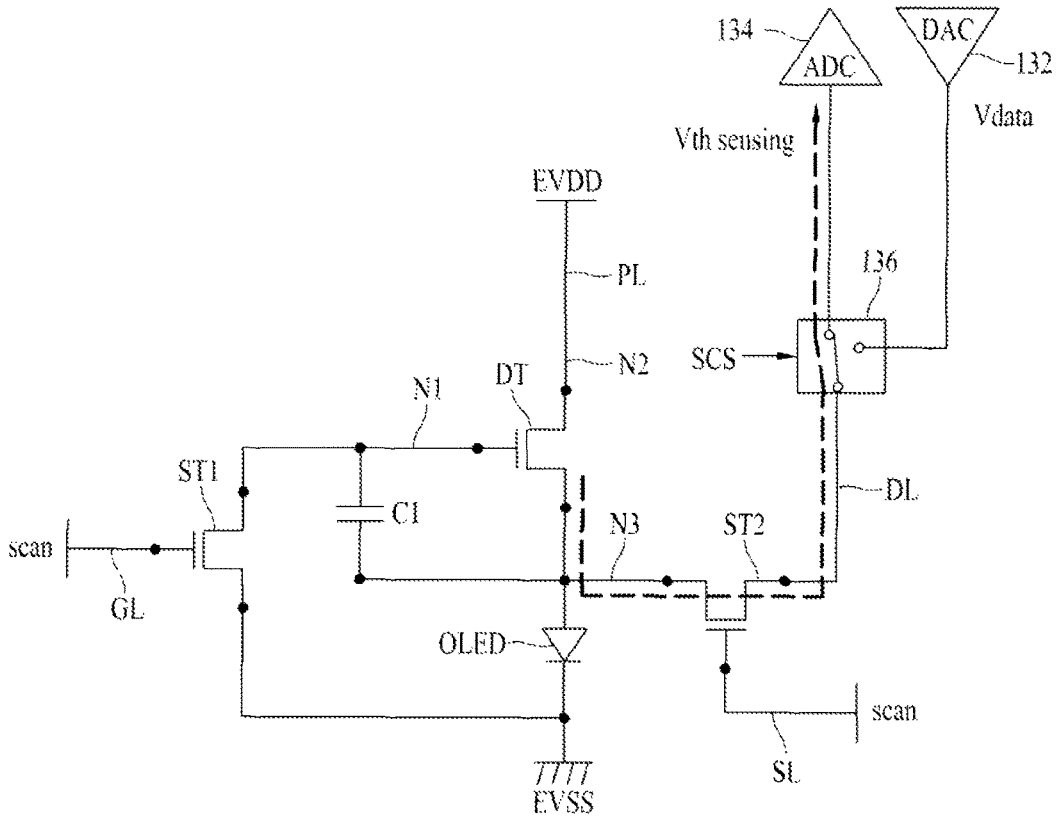
FIG. 8 illustrates a driving method of the pixel circuit for the sensing mode according to an embodiment of the present invention.

FIG. 7 is a waveform diagram of the sensing mode, and FIG. 8 illustrates a driving method of the pixel circuit for the sensing mode.

Referring to FIGS. 7 and 8, the first switching TFT (ST1) is turned-on by the scan signal (scan) applied thereto in accordance with the sensing mode, and the second driving power (EVSS) is supplied from the second driving power (EVSS) terminal to the first node (N1) connected with the gate electrode of the driving TFT (DT) in accordance with the sensing mode. Thus, the difference voltage (EVDD-Vgs) between the first driving power (EVSS) and the gate-source voltage (Vgs) is formed in the third node connected with the organic light emitting diode (OLED) and the drain electrode of the driving TFT (DT).

In this case, the sense signal (sense) is supplied to the second switching TFT (ST2), whereby the sensing voltage of the driving TFT (DT), that is, the voltage formed in the third node (N3) to which the organic light emitting diode (OLED) and the drain electrode of the driving TFT (DT) are connected is supplied to the data line (DL).

For the sensing mode, the plurality of switches 136 are switched by the switch control signal (SCS) input from the data driver 130, whereby the data line (DL) is connected with the analog-to-digital converter (ADC) 134. As the data line (DL) is connected with the analog-to-digital converter (ADC) 134, the sensing voltage of the driving TFT (DT) applied to the data line (DL) is supplied to the analog-to-digital converter (ADC) 134.

The analog-to-digital converter (ADC) 134 converts the sensing voltage of the driving TFT (DT), that is, the voltage of the drain node of the driving TFT (DT) input via the data line (DL) and the switch 136 into sensing data of digital type, and supplies the sensing data of digital type to the timing controller 140.

For the sensing mode, it is possible to reduce the sensing time for sensing the properties of the driving TFT for the entire pixels by overlapping the sensing time of applying the sense signal (sense) to the plurality of sense signal lines (SL).

For the overlap driving of the sense signal in the organic light emitting display device according to the present invention, it is possible to prevent a luminance deviation between the pixels between the pixels of the prior sense signal line and the pixels of the next sense signal line with respect to the corresponding sense signal line applied with the sense signal, thereby improving picture quality. Also, it is possible to improve the aperture ratio of pixel by removing the reference power line, and to reduce the number of channels in the data driver, thereby reducing the manufacturing cost of the organic light emitting display device according to the present invention.

According to the present invention, for the overlap driving of the sense signal in the organic light emitting display device according to the present invention, it is possible to prevent a luminance deviation between the pixels of the prior line and the pixels of the next line with respect to the corresponding sense signal line.

Also, it is possible to improve the picture quality for the overlap driving of the sense signal in the organic light emitting display device according to the present invention.

In addition, it is possible to improve the aperture ratio of pixel by removing the reference power line.

Also, it is possible to reduce the number of channels in the data driver by removing the reference power line, thereby decreasing the manufacturing cost of the organic light emitting display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

an organic light emitting diode (OLED) panel including an active area including a plurality of pixels and a non-active area devoid of pixels;

a data line;

a driving power line;

a sense signal line;

a gate line;

a data driver to supply a data voltage to the data line;

a gate driver to supply a sense signal to the sense signal line;

a light emitting diode having a cathode receiving a second driving power;

a driving thin film transistor (TFT) receiving a first driving power higher than the second driving power via a drain electrode and the driving power line, which is turned-on by the second driving power input to a gate electrode and the data voltage input to a source electrode, for supplying a driving current to the light emitting diode;

a first switching TFT, which is turned-on by a scan signal applied to the gate line, the first switching TFT including a source electrode directly connected to the cathode of the light emitting diode for supplying the second driving power to the gate electrode of the driving TFT;

a second switching TFT, which is turned-on by a sense signal applied to the sense signal line, for supplying the data voltage from the data line to the source electrode of the driving TFT and supplying a sensing voltage of the driving TFT to the data line; and a single switch connected with the data line by a first terminal, a digital-to-analog converter by a second terminal, and an analog-to-digital converter by a third terminal so as to supply the data voltage from the digital-to-analog converter to the source electrode of the driving TFT and to supply the sensing voltage to the analog-to-digital converter, thereby removing a reference power line, wherein the single switch connects the data line to the digital-to-analog converter or the analog-to-digital converter on a basis of a switch control signal input, wherein the sense signal is applied in an overlapping manner to a plurality of sense signal lines in a sensing mode, wherein the scan signal is sequentially applied to a plurality of gate lines and the plurality of sense signal lines, in a display mode, wherein the scan signal is sequentially applied to the plurality of gate lines and the sense signal is applied to each sensing block including the plurality of sense signal lines, in the sensing mode, wherein the sense signal is applied in synchronization with the scan signal by having a leading edge of the scan signal being aligned with a leading edge of the sense signal and a falling edge of the scan signal being aligned with a falling edge of the sense signal in the sensing mode, and wherein the single switch is disposed in the non-active area of the OLED panel and between the data driver and the active area including the plurality of pixels, the single switch is configured to switch a path between the analog-to-digital converter and the digital-to-analog converter in accordance with the single switch control signal input from the data driver, and a gate-drain voltage of the driving TFT is supplied through the data line to the analog-to-digital converter, via the single switch, in the sensing mode.

2. The display device of claim 1, wherein, when the data line is connected to the digital-to-analog converter or the analog-to-digital converter, the data voltage is supplied to a pixel of the display device, or a sensing voltage of the pixel is supplied to the analog-to-digital converter.

3. The display device of claim 1, wherein the single switch is switched by the single switch control signal in accordance with the display mode of the display device to connect the data line to the digital-to-analog converter.

4. The display device of claim 3, wherein when the data line is connected to the digital-to-analog converter, the data voltage is supplied from the digital-to-analog converter to the data line.

5. The display device of claim 1, wherein the switch is switched by the switch control signal in accordance with the sensing mode of the display device to connect the data line to the analog-to-digital converter.

6. The display device of claim 5, wherein when the data line is connected to the analog-to-digital converter, the sensing voltage of the driving TFT applied to the data line is supplied to the analog-to-digital converter.

7. The display device of claim 6, wherein the analog-to-digital converter converts the sensing voltage of the driving TFT input via the data line and the single switch into sensing data of a digital type, and supplies the sensing data of the digital type to a timing controller.

8. The display device of claim 1, further comprising:

a timing controller to drive the gate driver and the data driver in accordance with the display mode and the sensing mode of the display device.

9. The display device of claim 1, further comprising:

a capacitor connected between the gate and source electrodes of the driving TFT.

10. The display device of claim 1, wherein the digital-to-analog converter outputs the data voltage of a negative (−) polarity to the data line.

11. The display device of claim 1, wherein the second switching TFT, which is turned-on by the sense signal applied to the sense signal line, supplies a voltage of the source electrode of the driving TFT to the data line.

12. The display device of claim 1, wherein the analog-to-digital converter converts the voltage of the source electrode of the driving TFT, which is input via the data line and the single switch, into digital sensing data, and supplies the digital sensing data to a timing controller.

13. The display device of claim 1, wherein the driving TFT is between the light emitting diode and a first driving power terminal, wherein the first switching TFT is between the gate electrode of the driving TFT and a second driving power terminal, and wherein the second switching TFT is between the source electrode of the driving TFT and the data line.

14. A display device having a display mode and a sensing mode, the display device comprising:

an organic light emitting diode (OLED) panel including an active area including a plurality of pixels and a non-active area devoid of pixels;

a data line and a gate line crossing the data line;

a driving power line;

a sense signal line;

a data driver to supply a data voltage to the data line;

a gate driver to supply a sense signal to the sense signal line;

a light emitting diode having a cathode receiving a second driving power;

a driving thin film transistor (TFT) receiving a first driving power higher than the second driving power via a drain electrode and the driving power line, which is turned-on by the second driving power input to a gate electrode and the data voltage of negative polarity input to a source electrode, for supplying a driving current to the light emitting diode;

a first switching TFT, which is turned-on by a scan signal applied to the gate line, the first switching TFT including a source electrode directly connected to the cathode of the light emitting diode for supplying the second driving power to the gate electrode of the driving TFT;

a single switch connected with the data line by a first terminal, a digital-to-analog converter by a second terminal, and an analog-to-digital converter by a third terminal so as to supply the data voltage from the digital-to-analog converter to the source electrode of the driving TFT and to supply the sensing voltage to the analog-to-digital converter, thereby removing a reference power line; and a second switching TFT, which is turned-on by the scan signal applied to the sense signal line, for supplying the data voltage of negative polarity from the digital-to-analog converter to the source electrode of the driving TFT in the display mode, and for supplying a sensing voltage of driving TFT to the analog-to-digital converter in the sensing mode, wherein the first switching TFT is turned-on by the scan signal applied thereto, and the second driving power is supplied to a first node connected to the gate electrode of the driving TFT in the sensing mode, wherein the single switch connects the data line to the digital-to-analog converter or the analog-to-digital converter on a basis of a switch control signal input, wherein the sense signal is applied in an overlapping manner to a plurality of sense signal lines in a sensing mode, wherein the scan signal is sequentially applied to a plurality of gate lines and a plurality of sense signal lines, in the display mode, wherein the scan signal is sequentially applied to the plurality of gate lines and the sense signal is applied to each sensing block including the plurality of sense signal lines, in the sensing mode, wherein the sense signal is applied in synchronization with the scan signal by having a leading edge of the scan signal being aligned with a leading edge of the sense signal and a falling edge of the scan signal being aligned with a falling edge of the sense signal in the sensing mode, and wherein the single switch is disposed in the non-active area of the OLED panel and between the data driver and the active area including the plurality of pixels, the single switch is configured to switch a path between the analog-to-digital converter and the digital-to-analog converter in accordance with the single switch control signal input from the data driver, and a gate-drain voltage of the driving TFT is supplied through the data line to the analog-to-digital converter, via the single switch, in the sensing mode.

* * * * *